United States Patent [19]

Eriksson et al.

[11] Patent Number: 4,526,612

[45] Date of Patent: Jul. 2, 1985

[54] METHOD OF MANUFACTURING FERROSILICON

[75] Inventors: Sune Eriksson; Sven Santén, both of Hofors, Sweden

[73] Assignee: SKF Steel Engineering AB, Sweden

[21] Appl. No.: 526,412

[22] Filed: Aug. 25, 1983

[30] Foreign Application Priority Data

Sep. 8, 1982 [SE] Sweden ..... 8205086

[51] Int. Cl.[3] ..... C22B 4/00

[52] U.S. Cl. ..... 75/10 R; 75/11; 75/129

[58] Field of Search ..... 75/10–12, 75/129; 420/578

[56] References Cited

U.S. PATENT DOCUMENTS

| | | | |
|---|---|---|---|
| 3,431,103 | 3/1969 | Querengasser | 75/11 |
| 3,759,695 | 9/1973 | Downing | 75/11 |
| 4,072,504 | 2/1978 | Perdahl et al. | 75/40 |

*Primary Examiner*—Peter D. Rosenberg

*Attorney, Agent, or Firm*—Brumbaugh, Graves, Donohue & Raymond

[57] ABSTRACT

Ferrosilicon is manufactured from a material containing silica and a raw material containing iron by injecting these materials, possibly together with a reducing agent, with the help of a carrier gas into a plasma gas. The silica and the iron raw material, possibly with the reducing agent, heated in this way are then introduced with the energy-rich plasma gas into a reaction chamber surrounded by a solid reducing agent in lump form, the silica thus being brought to the molten state, being reduced and reacting with the iron to form ferrosilicon.

17 Claims, 1 Drawing Figure

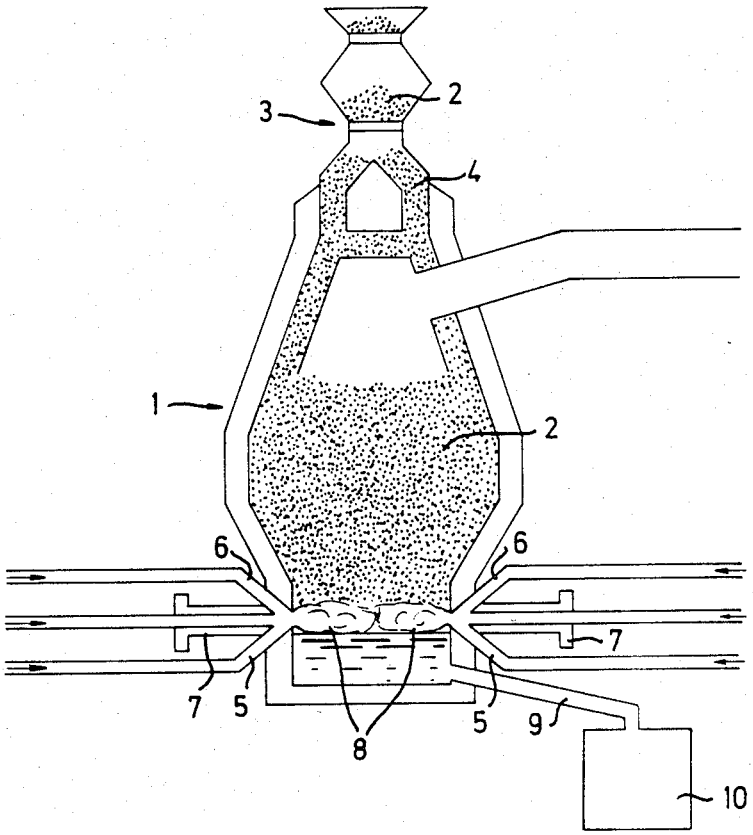
3
2
4
1
2
6
6
7
7
5
8
5
9
10

METHOD OF MANUFACTURING FERROSILICON

The present invention relates to a method of manufacturing ferrosilicon from a material containing silica, a material containing iron, and optionally a reducing agent, by direct reduction of the silica and simultaneous reaction between silicon and iron.

In the manufacture of ferrosilicon today, an electric furnace with Söderberg's electrodes is used. This necessitates a starting material in lump form, generally quartz, containing about 98% $SiO_2$ and small quantities of Al, Ca, P and As. The reducing agent used may be coke and coal in lump form with low ash content, and possibly also chips. The iron-containing raw material used is preferably small steel scrap, usually filings.

The process is usually carried out so that no slag is formed and rotary furnaces are used in preference. A relatively large amount of silicon becomes vaporized in the form of SiO which is oxidized outside the furnace to a white $SiO_2$ smoke. The higher the silicon content, the greater will be the quantity of silicon which is lost and the greater the energy consumption per ton alloy, and especially per ton recovered silicon.

The Table below shows the energy consumption for the most common silicon alloys, the yield and melting points.

TABLE

| | Grade, % Si | | | |
|---|---|---|---|---|
| | 45 | 75 | 90 | 98 |
| MWh/t alloy | 5-5.5 | 8.5-10 | 12-14 | 14-20 |
| Si yield % | 91 | 85 | 81 | 75 |
| MWh/t Si | 11.0 | 12.5 | 15.0 | 18.0 |
| Melting point °C. | 1300 | 1310 | 1380 | 1420 |

Ferrosilicon alloys are used primarily as alloy additives and for reducing oxides from slag, e.g. $Cr_3O_3$, but especially for deoxidation of steel. The most common ferrosilicon alloy contains 45% Si. Alloys with 75% Si and above dissolve in steel, producing heat. Silicon metal, i.e. 98% Si, is used as an additive, particularly for steel, but also for aluminium and copper. The alloy with 75% Si is also used, for instance, in silicogenetic reducing of magnesium.

Electric arc furnaces require a starting material in lump form, which limits the raw materials and complicates the use of very pure raw materials in powder form. If fine granular materials are to be used they must be agglomerated with the aid of some form of binder, which further increases process costs.

The electric arc furnace technique is also sensitive to the electrical properties of the raw materials. Since a starting material in lump form must be used, there is poorer contact locally between silica and reducing agent, thus giving rise to SiO loss and this loss is increased by the extremely high temperatures which occur locally in this process. Furthermore, it is difficult to maintain absolute reducing conditions above the charge in an arc furnace and this results in the SiO formed being reoxidized to $SiO_2$.

The factors described above are responsible for most of the losses sustained in manufacturing ferrosilicon. The SiO loss and the reoxidization of SiO to $SiO_2$ mentioned above result in considerable quantities of dust and this in turn entails the installation of expensive gas-purifying equipment.

The present invention provides a method of manufacturing ferrosilicon which comprises introducing a starting material containing a powdered silica-containing material and an iron-containing material, with a carrier gas, into a plasma gas generated by a plasma generator; introducing the silica and iron-containing material so heated, with the plasma gas into a reaction chamber surrounded substantially on all sides by a solid reducing agent in lump form, thereby bringing the silica to molten state and reducing it to silicon which combines with the iron to form ferrosilicon.

Thus, the method of the present invention enables the manufacture of ferrosilicon in a single step as well as permitting the use of raw materials in powder form. The silicon content in the final product can be pre-determined by controlling the iron added. The starting materials may, if desired, be injected together with an additional reducing agent.

The use of powdered raw materials proposed according to the invention makes the choice of silica raw materials easier and less expensive. The process proposed according to the invention is also insensitive to the electrical properties of the raw material, thus facilitating the choice of reducing agent. Furthermore, the permanent excess of reducing agent, since the reaction chamber is surrounded substantially on all sides by reducing agent in lump form, ensures that reoxidation of SiO is effectively prevented and the SiO formed will be immediately reduced to Si.

Quartz sand is preferably used as the material containing silica, and fed in together with the iron-containing raw material. Micropellets of quartz and coal dust are particularly suitable as the silica-containing material, the coal dust providing the additional reducing agent. The iron-containing raw material may be one containing free iron and comprise for example iron filings, sponge iron pellets or granulated iron. However, ferrous materials such as calcined pyrites containing e.g. about 66% Fe in the form of oxides may also be used as iron-containing material. Even materials containing ferric oxide may be used since these oxides are reduced at the same time as the silica is reduced to silicon. Oxide compounds of Fe and Si are also feasible as the starting material and $2FeO.SiO_2$ (fayalite) may be mentioned as an example.

When a reducing agent is injected with the starting material, this may be a hydrocarbon e.g. in liquid or gas form, such as natural gas, propane or light benzine, coal dust, charcoal powder, petroleum coke, which may be purified, and coke breeze.

The temperature required for the process can easily be controlled by the quantity of electric energy supplied per unit plasma gas so that the optimal conditions for the least possible SiO loss can be maintained.

According to a preferred embodiment of the invention the solid reducing agent in lump form is continuously supplied to the reaction zone as it is consumed. Suitably, wood, coal, coke, charcoal and/or petroleum coke may be used as the solid reducing agent in lump or bricket form. The solid reducing agent in lump form may be a powdered material which is converted to lump form e.g. brickets of charcoal powder. This is suitably achieved with the aid of a binder composed of C and H and possibly also O, e.g. sucrose.

According to another embodiment of the invention the gas plasma is generated by allowing the plasma gas to pass an electric arc in the plasma generator and preferably the plasma burner consists of an inductive plasma burner. Any impurities from the electrodes are thus reduced to an absolute minimum. The plasma gas used for the process consists preferably of process gas recirculated from the reaction zone or chamber.

The method proposed according to the invention is advantageous in the manufacture of extremely high-purity ferrosilicon, so that extremely pure silica and reducing agent with very low impurity content can be used as raw materials. Since the gas system is preferably closed, i.e. the process gas is recirculated, substantially all the energy can be utilized. Furthermore, the gas quantities are considerably smaller than in normal FeSi processes, a significant factor from the energy point of view. As mentioned earlier, the SiO is in principle entirely eliminated, and thus also the dust problem caused by $SiO_2$ smoke.

The method of the invention will now be described, by way of example, with reference to the accompanying drawing in which the sole FIGURE is a schematic sectional view of apparatus suitable for carrying out the invention method.

In the FIGURE a reactor 1, similar to a shaft furnace, has a blast furnace top 3, with an annular supply column 4 at the periphery of the shaft. Tuyères 5,6 are provided at the bottom of reactor 1 having orifices in front of a plasma generator 7 and leading to a reaction chamber 8. A channel 9 leads from the bottom of reactor 1 to a container 10.

In operation, the reactor 1 is continuously charged at the top through the annular supply column 4 (or, alternatively, in another embodiment through evenly distributed closed supply channels) with a solid reducing agent 2. If iron pellets or other iron-containing material in lump form is used, this is also preferably supplied at the top of reactor 1. Powdered material containing silica, possibly pre-reduced, and any powdered iron-containing raw material are blown in at the bottom of the reactor 1 through the tuyères 5, 6 with the aid of a carrier gas, e.g. an inert or reducing gas. The orifices of the tuyères 5, 6 in front of plasma generator 7 are thus in a plasma gas generated thereby.

Hydrocarbon and possibly even oxygen gas may be blown in simultaneously, preferably through the same tuyères. The iron is added, preferably in metallic form to the reaction zone or chamber 8. However, as mentioned earlier, ferric oxide may be added which becomes reduced to iron in the reaction chamber 8, which then combines with silicon to form ferrosilicon.

Reaction chamber 8 is filled with and surrounded on substantially all sides by reducing agent 2 in lump form. Reaction chamber 8 is formed by the hot mixture burning out a space which is continuously re-formed as the walls of reducing agent cave in. The reduction of the silica, and ferric oxide if present, and melting occur instantaneously in this reduction zone.

Liquid alloy metal produced is tapped off at the bottom of the reactor through channel 9 and collected in container 10.

The reactor gas leaving, consisting of a mixture of carbon monoxide and hydrogen in high concentration, is preferably recirculated and used to generate the plasma gas and as transport gas or carrier gas for the powder charge.

The process arrangement according to the invention enables the entire reaction to be concentrated in a very limited reaction zone in the immediate vicinity of the tuyère, thus enabling the high-temperature volume in the process to be greatly limited. This is a considerable advantage over conventional process in which the reduction reactions take place successively, spread over a large furnace volume.

Due to this design of the process, with all reactions taking place in a single reaction zone in the coke stack immediately in front of the plasma generator, the reaction zone or chamber can be kept at an extremely high and controllable temperature level. This promotes the reaction:

$$SiO_2+2C \rightarrow Si+2CO.$$

All the reactants, such as $SiO_2$, SiO, SiC, Si, C, CO, are present in the reaction zone or chamber simultaneously and SiO and SiC products formed in small quantities immediately react as follows:

$$SiO+C \rightarrow Si+CO$$

$$SiO+SiC \rightarrow 2Si+CO$$

$$2SiC+SiO_2 \rightarrow 3Si+2CO$$

The liquid silicon so produced reacts with liquid iron in the reaction zone while the gaseous CO leaves the reaction zone.

The present invention will now be illustrated, with reference to the following Examples.

EXAMPLE 1

An experiment was performed in half-size scale. Sea sand having a particle size below 1.0 mm was used as the silica raw material and iron filings as the iron raw material. The "reaction chamber" was defined by coke as reducing agent in lump form. Propane (LPG) was present as reducing agent in the initial charge and washed reduction gas consisting of CO and $H_2$ was used as carrier gas and plasma gas.

The electric input was 1000 kW. 2.5 kg $SiO_2$/minute and 0.4 kg Fe/minute were supplied as raw materials and 1.5 kg carbon per minute as reducing agent.

A total of about 500 kg ferrosilicon containing 75% Si was produced during the experiment. The average electricity consumption was about 10 kWh/kg ferrosilicon produced.

EXAMPLE 2

Ferrosilicon was produced using powdered ferric oxide as iron raw material and the same conditions otherwise as in Example 1.

In this experiment 300 kg ferrosilicon containing 75% Si was produced. The average electricity consumption was about 11 kWh/kg ferrosilicon produced.

Since the experiments of Examples 1 and 2 were performed on a relatively small scale the heat loss was considerable. However, the electricity consumption can be further reduced by means of gas recovery and the heat losses also decrease significantly in a larger plant.

We claim:

1. A continuous method of manufacturing ferrosilicon which comprises continuously injecting a starting material substantially in fine grained form and containing a silica-containing material and an iron-containing material, with a carrier gas, into a plasma gas generated by a plasma generator; thereby heating the material and continuously introducing the silica- and iron-containing material so heated, with the plasma gas into a reaction chamber surrounded substantially on all sides by a solid reducing agent in lump form, thereby bringing the silica to molten state and reducing it to silicon and causing said silicon to combine with the iron to form ferrosilicon.

2. A method according to claim 1, in which gas plasma is generated by allowing the plasma gas to pass an electric arc in a plasma generator.

3. A method according to claim 2, in which the arc in the plasma generator is generated inductively.

4. A method according to claim 1, in which the plasma gas comprises process gas recirculated from the reaction chamber.

5. A method according to claim 1 in which the solid reducing agent in lump form is added continuously to the reaction chamber.

6. A method according to claim 1 in which the solid reducing agent in lump form is selected from the group consisting of wood, coal and coke.

7. A method according to claim 1 in which the solid reducing agent in lump form is selected from the group consisting of brickets of petroleum coke, brickets of charcoal powder and lumps of charcoal.

8. A method according to claim 1 in which the starting material is introduced together with a reducing agent.

9. A method according to claim 8 in which the reducing agent introduced with the starting material is selected from the group consisting of charcoal powder, powdered petroleum coke and hydrocarbons in gas and liquid form.

10. A method according to claim 9 in which the reducing agent is selected from the group consisting of natural gas, propane and light benzine.

11. A method according to claim 1 in which the silica-containing material is quartz sand.

12. A method according to claim 1 in which the iron-containing material is one containing free iron.

13. A method according to claim 12, in which the iron-containing material is selected from the group consisting of iron pellets and iron filings.

14. A method according to claim 1 in which the iron-containing material is one containing ferric oxide.

15. A method according to claim 1 in which the iron-containing material is calcined pyrites.

16. A method according to claim 1 in which the silica and iron are compounded in one material as starting material.

17. A method according to claim 16 in which the starting material comprises fayalite slags, said slags comprising primarily $2FeO.SiO_2$.

* * * * *